US008027617B2

(12) United States Patent
Ishida

(10) Patent No.: US 8,027,617 B2
(45) Date of Patent: Sep. 27, 2011

(54) IMAGE FORMING APPARATUS

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 473 days.

(21) Appl. No.: 11/944,899

(22) Filed: Nov. 26, 2007

(65) Prior Publication Data

US 2008/0124124 A1 May 29, 2008

(30) Foreign Application Priority Data

Nov. 29, 2006 (JP) ..... 2006-322677

(51) Int. Cl.
*G03G 21/00* (2006.01)

(52) U.S. Cl. ..... 399/129; 399/50; 399/175

(58) Field of Classification Search ..... 399/50, 399/127–129, 168, 175, 176, 297–299, 302
See application file for complete search history.

(56) References Cited

U.S. PATENT DOCUMENTS

| | | | | |
|---|---|---|---|---|
| 6,006,055 | A * | 12/1999 | Furuya | 399/149 |
| 6,314,251 | B1 * | 11/2001 | Gomi et al. | 399/38 |
| 6,421,512 | B2 | 7/2002 | Watanabe et al. | |
| 6,438,343 | B1 * | 8/2002 | Inoue | 399/149 |
| 6,952,546 | B2 * | 10/2005 | Yoshikawa | 399/129 |
| 2005/0254856 | A1 * | 11/2005 | Miura et al. | 399/159 |
| 2007/0292152 | A1 | 12/2007 | Ishida | |

FOREIGN PATENT DOCUMENTS

| | | | |
|---|---|---|---|
| JP | 2000-47545 | A | 2/2000 |
| JP | 2001-215798 | A | 8/2001 |
| JP | 2001-215799 | A | 8/2001 |
| JP | 2004-117960 | A | 4/2004 |

* cited by examiner

*Primary Examiner* — David Porta
*Assistant Examiner* — Benjamin Schmitt
(74) *Attorney, Agent, or Firm* — Fitzpatrick, Cella, Harper & Scinto

(57) ABSTRACT

In the case where image formation is performed by using a part of a plurality of image forming units, an associated image bearing member of a remaining part of the plurality of image forming units is rotated together with an intermediary transfer member or a recording material carrying member while a voltage of a polarity opposite to that of polishing particles is applied to an electric charge imparting member.

4 Claims, 10 Drawing Sheets

(a)

(b)

IMAGE FORMING APPARATUS

FIELD OF THE INVENTION AND RELATED ART

The present invention relates to a cleaner-less image forming apparatus having a developing means for collecting toner remaining on an image bearing member while developing an electrostatic image formed on the image bearing member. For example, the present invention relates to an image forming apparatus utilizing electrostatic recording or electrophotography, such as a copying machine or a laser beam printer.

An image forming apparatus using electrophotography such as a copying machine, a printer, or a facsimile apparatus have generally included an electrophotographic photosensitive member as an image bearing member and a charging apparatus for electrically charging the photosensitive member uniformly to a predetermined polarity and a predetermined potential (charging step). The charged photosensitive member is exposed to light by an exposure apparatus as an information writing means to form thereon an electrostatic latent image (exposure step). The electrostatic latent image formed on the photosensitive member with toner as a developer contained in a developing apparatus is visualized as a developer image (toner image) (developing step). By a transfer apparatus, the toner image is transferred from a surface of the photosensitive member onto a recording material such as paper (transfer step). By a cleaning apparatus, toner remaining in the photosensitive member after the transfer step (residual developer or transfer residual toner) is removed to clean the photosensitive member surface (cleaning step). By a fixing apparatus, the toner image on the recording material is fixed (fixing step). The photosensitive member is repetitively subjected to an electrophotographic process (charging step, exposure step, developing step, transfer step, cleaning step, fixing step) described above to form an image.

The toner remaining on the photosensitive member after the transfer step is removed as described above from the surface of the photosensitive member by the cleaning apparatus and is collected in the cleaning apparatus as waste toner. However, from the viewpoints of environmental protection and effective use of sources, it is desirable that the waste toner is not produced.

For this reason, an image forming apparatus in which transfer residual toner (so-called waste toner) collected by a cleaning apparatus is collected by a developing apparatus and then utilized again has been proposed.

Further, Japanese Laid-Open Patent Application (JP-A) 2004-117960 has proposed a cleaner-less image forming apparatus wherein a cleaning apparatus is omitted and transfer residual toner on a photosensitive member after a transfer step is removed and collected from the photosensitive member by a developing apparatus according to simultaneous development and cleaning, and is utilized again.

In the simultaneous development and cleaning, the transfer residual toner on the photosensitive member after the transfer step is collected in the developing apparatus during a developing step of a subsequent step or later. More specifically, first, the photosensitive member to which the transfer residual toner is attached is further subjected to charging and exposure to light to form an electrostatic latent image.

During the developing step of the electrostatic latent image the transfer residual toner present at a portion (non-image portion) which is not intended to be developed is removed and collected in the developing apparatus by a fog-removing bias (Vback). The fog-removing bias (Vback) is a fog-removing potential difference Vback between a DC voltage applied to the developing apparatus and a surface potential of the photosensitive member.

According to this method, the transfer residual toner is collected in the developing apparatus and utilized again for developing an electrostatic latent image in a subsequent step or later, so that the waste toner can be eliminated or reduced and a maintenance operation can also be reduced. Further, in the cleaner-less method, the surface of the photosensitive member is not abraded by a cleaner, so that a thickness of a surface layer of the photosensitive member is kept at a constant level to ensure an increase in life-span of the photosensitive member. The cleaner-less method is also advantageous for downsizing of the image forming apparatus.

In the cleaner-less image forming apparatus employing the above-described simultaneous development and cleaning, a contact charging apparatus for electrically charging the surface of the photosensitive member by contact with the photosensitive member can be used as the charging apparatus. In this case, when the transfer residual toner on the photosensitive member passes through a contact nip (charging portion) between the photosensitive member and the contact charging apparatus, a part of the transfer residual toner, particularly toner which has been reversely charged to an opposite polarity to a normal polarity as a charge polarity, can be deposited on the contact charging apparatus. As a result, the contact charging apparatus is contaminated with the toner at a level exceeding an acceptable range, thus causing improper charging.

More specifically, in the toner as the developer, reversely charged toner having a polarity opposite to the normal charge polarity of the toner is originally contained in mixture although an amount thereof is small. Further, even the toner having the normal charge polarity can be reversely charged by the influence of a transfer bias or separation electric discharge or reduced in amount of electric charge by electric discharge. For this reason, the transfer residual toner contains the normally charged toner, the reversely charged toner, and toner having a small charge amount in mixture. The reversely charged toner or the toner having the small charge amount in the transfer residual toner is deposited onto the contact charging apparatus when the transfer residual toner passes through the contact nip (charging portion) between the photosensitive member and the control charging apparatus.

In order to remove and collect the transfer residual toner on the photosensitive member by the developing apparatus through simultaneous development and cleaning, the charge polarity of the transfer residual toner, on the photosensitive member, which is carried to the developing portion after passing through the charging portion, is required to be the normal charge polarity. In addition, the charge amount of the transfer residual toner is required to be a charge amount of toner capable of developing the electrostatic latent image on the photosensitive member by the developing apparatus.

The reversely charged toner and toner having an improper charge amount cannot be removed and collected from the photosensitive member to the developing apparatus, thus leading to a defective image.

In order to prevent the toner from depositing on the contact charging apparatus, the charge polarities of the transfer residual toner containing the normally charged toner, the reversely charged toner, and the toner having the small charge amount in mixture which are carried on the photosensitive member from the transfer portion to the charging portion are required to be uniformized to have the normal charge polarity. In addition, the charge amounts of the transfer residual toner are required to be uniformized.

For this reason, in a movement direction of the photosensitive member, a toner charge amount control means for electrically charging the transfer residual toner has been conventionally provided as an auxiliary charging means at a position upstream from the contact charging apparatus and downstream from a transfer means. Further, at a position upstream from the toner charge amount control means and downstream from the transfer means, a transfer residual toner uniformizing means for uniformizing the transfer residual toner on the photosensitive member has been provided as an auxiliary charging means. This auxiliary charging means is provided in contact with the photosensitive member surface. By applying a certain DC voltage to these transfer residual toner uniformizing means and toner charge amount control means, the above-described problem has been solved (e.g., JP-A 2001-215798 and JP-A 2001-215799).

More specifically, the transfer residual toner remaining on the photosensitive member after the transfer is uniformized by the transfer residual toner uniformizing means, and the uniformized transfer residual toner is electrically charged to the normal polarity by the toner charge amount control means. Thereafter, the surface of the photosensitive member is electrically charged by the contact charging apparatus and at the same time, the transfer residual toner which has been electrically charged by the toner charge amount control means is electrically charged to have an amount of electric charge suitable for removal and collection by the developing apparatus through simultaneous development and cleaning, thus being collected by the developing apparatus.

It has been known that a corona (discharge) product generated due to the presence of high-voltage members such as the charging member and the transfer member in the image forming apparatus is deposited on the surface of the image bearing member to constitute a contaminant and the contaminant lowers an electric resistance at the surface of the image bearing member, particularly in a high-humidity environment, and prevents formation of a clear electrostatic latent image, thus causing deterioration in image quality (image flow). Examples of factors causing the occurrence of such image flow may include a component resulting in nitrate ion generated by oxidation of nitrogen in the air together with generation of various metal oxides and oxygen compounds during the corona discharge. The corona (discharge) product deposits on the surface of the image bearing member, thus forming a thin film (filming layer) on the photosensitive member surface. This filming layer takes up moisture in the high-humidity environment to lower the electric resistance at the photosensitive member surface, thus preventing formation of the clear electrostatic latent image. As a result, the filming layer leads to the deterioration in image quality. The image flow problem is solved by mounting a drum heater to the photosensitive member. However, the mounting of the drum heater increases a production cost of the image forming apparatus.

Further, the image flow can be prevented by a method of removing the corona discharge product by rubbing the photosensitive member surface. However, in the case of the above-described cleaner-less method, the image forming apparatus does not include the cleaning apparatus for rubbing the photosensitive member, so that it is difficult to remove the corona discharge product.

As in a constitution described in JP-A 2000-47545, a method of removing an electric discharge product at the surface of a photosensitive member by storing polishing particles in a cleaning apparatus can be applied. More specifically, the above-described auxiliary charging means is caused to contact the photosensitive member, and the polishing particles for polishing the photosensitive member surface are contained in mixture with a developer in a developing apparatus. Then, it can be considered that the polishing particles are deposited on the auxiliary charging means from the developing apparatus through the photosensitive member to remove the discharge product at the surface of the photosensitive member.

The polishing particles are caused to have an opposite polarity to the charge polarity of the toner (e.g., a positive charge polarity in the case where the toner has a negative charge polarity), so that the polishing particles are subjected to development at a white background portion (at a fog removing bias Vback) and are not transferred due to the opposite polarity to the charge polarity of the toner, thus being collected by the auxiliary charging means.

In order to prevent image flow occurring after an image forming apparatus is left standing for a long term, it has been widely performed that a discharge product deposited to the surface of the photosensitive member is removed by carrying out an idling operation of the photosensitive member when a power source of the image forming apparatus is turned on. Particularly, in the case of the above-described cleaner-less system (method), by depositing the polishing particles on the auxiliary charging means, it is possible to effectively remove the discharge product during the idling operation of the photosensitive member.

However, in the case of idling the photosensitive member, the polishing particles which have been deposited on the auxiliary charging means (apparatus) are removed by rubbing with the photosensitive member (drum), thus being used up. For this reason, a polishing effect of the polishing particles in the auxiliary charging means is lowered, so that there is a possibility that the image flow cannot be effectively suppressed.

SUMMARY OF THE INVENTION

A principal object of the present invention is to provide a cleaner-less tandem type image forming apparatus capable of suppressing image flow caused by deposition of corona (discharge) product on the surface of an image bearing member.

Another object of the present invention is to provide an image forming apparatus capable of preventing use-up of polishing particles at an electric charge imparting means even when an image bearing member is idled in such an image forming apparatus that the polishing particles are carried by the electric charge imparting means and can be rubbed against the image bearing member.

According to an aspect of the present invention, there is provided an image forming apparatus comprising:

a plurality of image forming units, each comprising an image bearing member for bearing a toner image, charging means for electrically charging a surface of the image bearing member, latent image forming means for forming an electrostatic latent image on the image bearing member electrically charged by the charging means, developing means for developing the electrostatic latent image with a developer containing toner and polishing particles which have a charge polarity opposite to that of the toner and are effective for polishing the image bearing member, transfer means for transferring a toner image formed on the image bearing member onto a recording material, and electric charge imparting means which is disposed in contact with the image bearing member while carrying polishing particles supplied from the developing means and is effective for imparting an electric charge to toner remaining on the image bearing member without being transferred by the transfer means;

a recording material carrying member, for carrying the recording material to a transfer position of each of the image bearing members of the plurality of image forming units, disposed in contact with an intermediary transfer member which is disposed in contact with the image bearing member and onto which the toner image is transferred from each of the image bearing member or disposed in contact with each of the image bearing member; and executing means for executing a mode in which a voltage of a polarity opposite to that of the polishing particles is applied to the electric charge imparting means of a part of the image forming units which are not subjected to image formation, when a remaining part of the image forming units is subjected to image formation, while said image bearing member of the part of the image forming units which are not subjected to image formation is rotated together with the intermediary transfer member or the recording material carrying member.

According to another aspect of the present invention, there is provided an image forming apparatus comprising:

an image bearing member for bearing a toner image;

charging means for electrically charging a surface of the image bearing member;

latent image forming means for forming an electrostatic latent image on the image bearing member electrically charged by the charging means;

developing means for developing the electrostatic latent image with a developer containing toner and polishing particles which have a charge polarity opposite to that of the toner and are effective for polishing the image bearing member;

transfer means for transferring a toner image formed on the image bearing member onto a recording material;

electric charge imparting means which is disposed in contact with the image bearing member while carrying polishing particles supplied from the developing means and is effective for imparting an electric charge to toner remaining on the image bearing member without being transferred by the transfer means; and executing means capable of executing a mode, in advance of a start of image formation after power on, in which the image bearing member is idled while a voltage of a polarity of a polarity opposite to that of the polishing particles at a level such that electric discharge between the image bearing member and the electric charge imparting means is applied to the electric charge imparting means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the image forming apparatus according to the present invention will be described more specifically with reference to the drawings.

Embodiment 1

First, general constitution and operation of an image forming apparatus according to this embodiment of the present invention will be described.

(General Constitution and Operation of Image Forming Apparatus)

Figure 1:
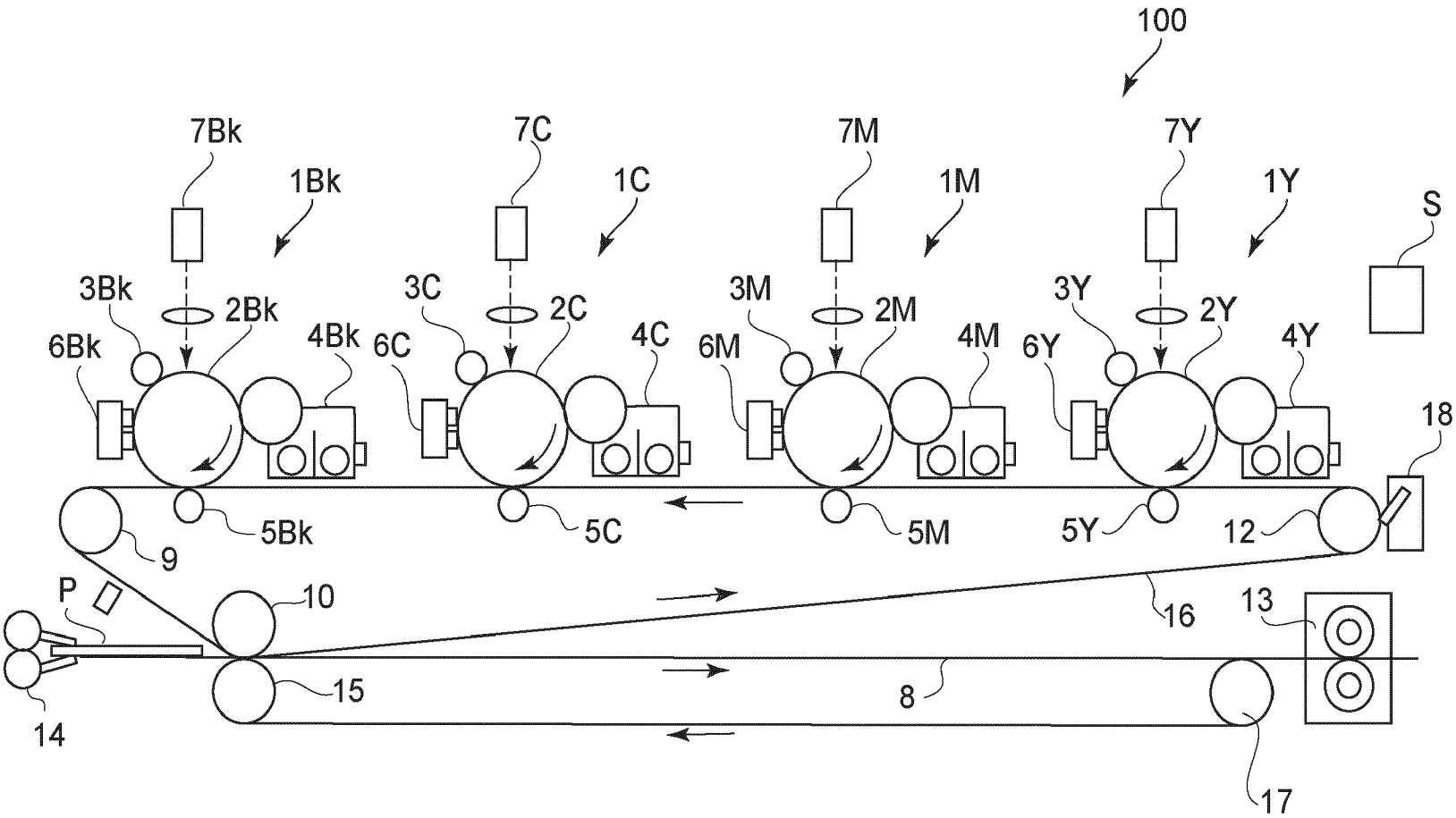
FIG. 1 is a schematic constitutional view of an embodiment of an image forming apparatus according to the present invention.

FIG. 1 is a schematic constitutional view of an image forming apparatus 100 of this embodiment. The image forming apparatus 100 is an electrophotographic full-color printer including four image forming units 1Y, 1M, 1C and 1Bk for forming images of yellow (Y), magenta (M), cyan (C) and black (Bk), respectively. In this embodiment, the image forming apparatus 100 is capable of forming a four-color based full-color image on a recording material P depending on an image signal inputted from host equipment, such as an original reading apparatus or a personal computer, communicatably connected to a main assembly of the image forming apparatus 100. The recording material P may be a recording sheet, a plastic film, a cloth, etc.

At the image forming portions units 1Y, 1M, 1C and 1D, on electrophotographic photosensitive members 2Y, 2M, 2C and 2Bk as image bearing members, toner images of yellow, magenta, cyan and black are formed, respectively. The thus formed color toner images on the photosensitive members are transferred onto an intermediary transfer belt 16 as a transfer medium. Then, the toner images on the intermediary transfer belt 16 are transferred onto the recording material P carried and conveyed by a conveying belt 8 as a recording material carrying medium.

Each of the four image forming units 1Y, 1M, 1C and 1Bk provided to the image forming apparatus 100 has a substantially identical constitution except for a difference in developing color. In the following, in the case where these image forming units are not required to be particularly distinguished from each other, symbols Y, M, C and Bk for members or means for the respective image forming units are omitted and the members or means will be collectively described.

At an image forming unit 1, a cylindrical electrophotographic photosensitive member, i.e., a photosensitive drum 2 as an image bearing member is provided. The photosensitive drum 2 is rotationally driven at a predetermined speed in a direction indicated by an arrow. Around the photosensitive drum 2, members including a charging roller 3 as a charging means, a developing apparatus 4 as a developing means, a primary transfer roller 5 as a transfer means, and an auxiliary charging apparatus 6 as an auxiliary charging means are disposed. Above the photosensitive drum 2, a laser scanner (exposure apparatus) 7 as an exposure means (latent image forming means) is disposed. Further, the intermediary transfer belt 16 is disposed opposite to each photosensitive drum 2 of an associated image forming unit 1. The intermediary transfer belt 16 is rotated and moved in directions indicated by arrows by actuation of a drive roller 9, a secondary transfer opposite roller 10, and a follower roller 12 and conveys the toner image to a contact portion (secondary transfer position) with the recording material P. Below the intermediary transfer belt 16, the conveying belt 8 for carrying and conveying the recording material P is disposed. The conveying belt 8 is stretched between a supporting roller 17 and a secondary transfer roller 15 disposed opposite to the secondary transfer opposite roller 10 and is rotated and moved in directions indicated by arrows. The toner image is, after being transferred from the intermediary transfer belt 16 onto the recording material P, heat-fixed on the recording material P by a fixing apparatus 13.

Next, four-color based full-color image formation will be described. When an image forming operation is started, at each of the image forming portions, the surface of the rotating photosensitive drum 2 is electrically charged uniformly by the charging roller 3. At this time, to the charging roller 3, a charging bias is applied from a charging bias power source S1. Then the photosensitive drum 2 is exposed to laser light, corresponding to an image signal, emitted from the exposure apparatus 7. As a result, an electrostatic image (latent image) corresponding to the image signal is formed on the photosensitive drum 2. The electrostatic image on the photosensitive drum 2 is developed (visualized) with toner contained in the developing apparatus 4 to provide a visible image (toner image). In this embodiment, a reverse developing method in which the toner is deposited at a portion exposed to the laser light (light part potential portion) is used. The toner image is formed on the photosensitive drum 2 by the developing apparatus 4 and is primary-transferred onto the intermediary transfer belt 16. After the primary transfer, toner remaining on the photosensitive drum 2 surface (transfer residual toner) is collected in the developing apparatus 4 after passing through the auxiliary charging apparatus 6.

The above-described image forming operation is successively performed at the four image forming units 1Y, 1M, 1C and 1Bk to transfer the four color toner images of yellow, magenta, cyan and black on the intermediary transfer belt 16 in a superposition manner. Thereafter, in synchronism with toner image forming timing, the recording material P contained in a recording material accommodating cassette (not shown) is conveyed to a secondary transfer position by a sheet feeding roller 14 and the conveying belt 8. Then, the four color toner images on the intermediary transfer belt 16 are secondary-transferred collectively onto the surface of the recording material P by applying a secondary transfer bias to the secondary transfer roller 15.

Then, the recording material P is separated from the conveying belt 8 and conveyed into the fixing apparatus 13 as the fixing means. By the fixing apparatus 13, the toner on the recording material P is melted and mixed under application of heat and pressure to result in a permanent full-color toner image. Thereafter, the recording material P is discharged out of the image forming apparatus.

Further, the toner which has not been completely transferred at the secondary transfer portion, at which the secondary transfer roller 15 is disposed, and which remains on the intermediary transfer belt 16 is removed by an intermediary transfer belt cleaner 18. Thus, a series of operations is completed.

It is also possible to form a desired single color image or a desired plurality of color images by using only desired image forming unit(s).

(Operation of Image Forming Unit)

Figure 2:
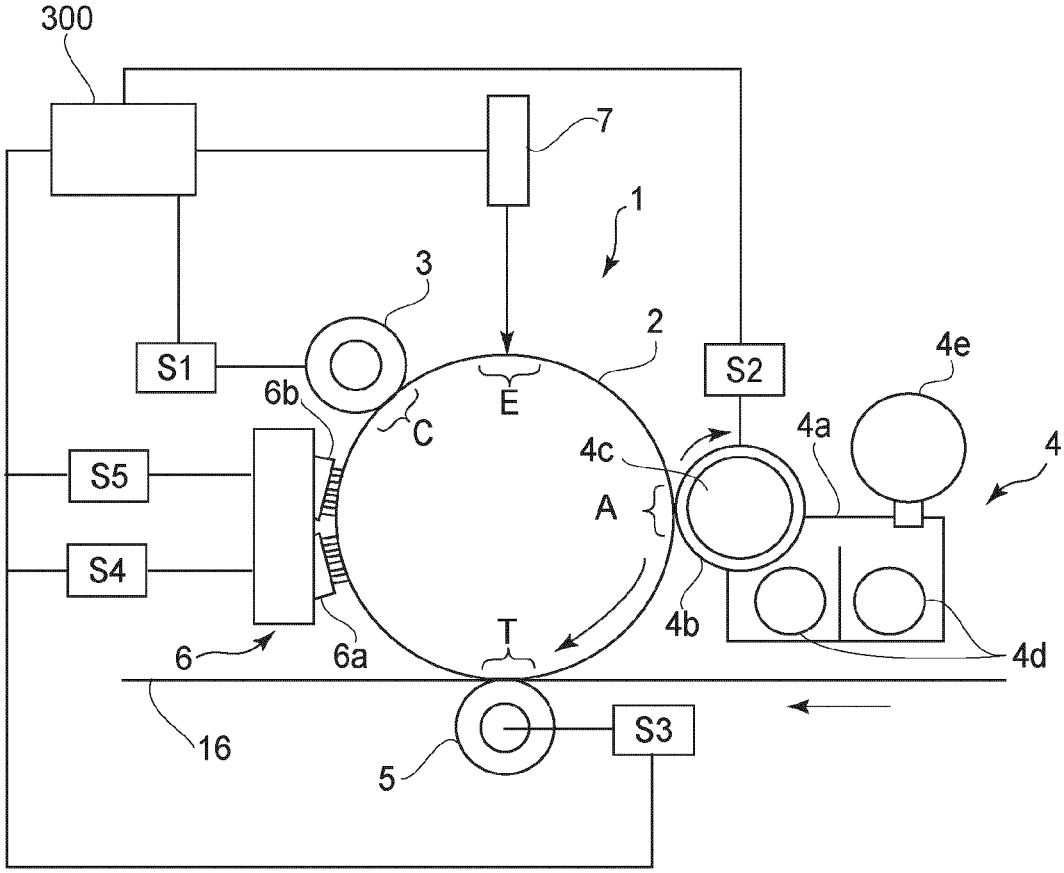
FIG. 2 is a detailed constitutional view, of an image forming unit of the image forming apparatus of the present invention, for illustrating a cleaner-less system.

The operation in the image forming unit 1 will be described more specifically with reference to FIG. 2.

In this embodiment, the photosensitive drum 2 is an organic photoconductor (OPC) having a negatively chargeable charging characteristic and is rotationally driven in a clockwise direction indicated by an arrow with a central shaft having an outer diameter of 30 mm as a center.

As the charging means for electrically charging the surface of the drum 2 uniformly, the image forming unit 1 includes the contact charging apparatus (contact charger) 3. In this embodiment, the contact charging apparatus 3 is a charging roller (roller charger) and electrically charges the photosensitive drum surface by utilizing an electric discharge phenomenon occurring in a minute gap between the charging roller 3 and the photosensitive drum 2. To the charging roller 3, a charging bias voltage is applied from the power source S1 under a predetermined condition. As a result, the surface of the rotating photosensitive drum 2 is contact-charged electrically to a predetermined polarity and a predetermined potential. In this embodiment, the charging bias voltage applied to the charging roller 3 is an oscillating voltage in the form of a DC voltage (Vdc) biased with an AC voltage (Vac). More specifically, the charging bias voltage is an oscillating voltage in the form of a DC voltage of −500 V biased with a sinusoidal wave AC voltage having a frequency of 1.3 kHz and a peak-to-peak voltage Vpp of 1.5 kV. By the application of the charging bias voltage, the surface of the photosensitive drum 2 is electrically charged uniformly to a voltage (dark part potential Vd) of −500 V identical to the DC voltage applied to the charging roller 3.

In this embodiment, the developing apparatus 4 is a developing apparatus employing a two-component developing method in which development is effected while a magnetic brush of a two-component developer containing toner and a carrier is caused to contact the photosensitive drum 2. The developing apparatus 4 includes a developing container 4*a* and a nonmagnetic developing sleeve 4*b* as a developer carrying member. The developing sleeve 4*b* is externally exposed at a part of its outer peripheral surface and disposed in the developing container 4*a*. In the developing sleeve 4*b*, the two-component developer is contained and a magnet roller 4*c* is nonrotationally inserted. The developing container 4*a* contains the two-component developer and on a bottom side of the developing container 4*a*, developer stirring members 4*d* are disposed. Further, toner for supply is contained in a toner hopper 4*e*. The two-component developer in the developing container 4*a* principally comprises nonmagnetic toner and a magnetic carrier in mixture and is stirred by the developer stirring members 4*d*. In this embodiment, the toner comprises colored resin particles containing a binder resin material, a colorant, and other additives as desired. The toner comprises negatively chargeable particles of polyester resin produced through a polymerization method and may preferably have a volume-average particle size of 5 μm or more and 8 μm or less. In this embodiment, the volume-average particle size is 6.2 μm. The toner is negatively charged by rubbing with the magnetic carrier.

As the carrier, e.g., it is possible to suitably use magnetic particles of metals such as surface-oxidized iron, surface-unoxidized iron, nickel, cobalt, manganese, chromium, and rare-earth metals; their alloys; and ferrite oxides. A production method of these magnetic particles is not particularly limited. The carrier may have a weight-average particle size of 20-50 μm, preferably 30-40 μm and a volume resistivity of $10^7$ Ω·cm or more, preferably $10^8$ Ω·cm or more. In this embodiment, the carrier used has a volume resistivity of $10^8$ Ω·cm. In this embodiment, as a low-density magnetic carrier, a magnetic resin carrier produced through a polymerization of a mixture of a magnetic metal oxide and a nonmagnetic metal oxide in a phenolic binder resin material at a predetermined mixing ratio is used. The magnetic resin carrier has a volume-average particle size of 35 μm, a true density of 3.6-3.7 g/cm$^3$, and a magnetization of 53 A·m$^2$/kg.

The developing sleeve 4*b* is held and closely disposed opposite to the photosensitive drum 2 with a closest distance (S-D gap) of 350 μm. An opposite portion between the photosensitive drum 2 and the developing sleeve 4*b* is a developing portion A. The developing sleeve 4*b* is rotationally driven in a direction opposite from the rotation (movement) direction of the photosensitive drum 2 at the developing portion A. BY a magnetic force of the magnetic roller 4*c* in the developing sleeve 4*b*, a part of the two-component developer in the developing container 4*a* is adsorbed and held by the developing sleeve 4*b* as a magnetic brush layer at the outer peripheral surface of the developing sleeve 4*b*. The magnetic brush layer is rotationally conveyed by the rotation of the developing sleeve 4*b* and appropriately rubs the photosensitive member surface at the developing portion A in contact with the surface of the photosensitive drum 2. To the developing sleeve 4*b*, the predetermined developing bias (voltage) is applied from the power source S2. In this embodiment, the developing bias voltage applied to the developing sleeve 4*b* is an oscillating voltage in the form of a DC voltage (Vdc) biased with an AC voltage (Vac). More specifically, the oscillating voltage is in the form of a DC voltage of −350 V and a rectangular wave AC voltage having a frequency of 8.0 kHz and a peak-to-peak voltage of 1.8 kV.

The surface of the rotating developing sleeve 4*b* is coated with the magnetic brush layer as a thin layer, and the toner in the developer conveyed to the developing portion A is selectively deposited corresponding to the electrostatic latent image on the surface of the photosensitive drum 2 by an electric field generated by the developing bias voltage, so that the electrostatic latent image is developed as a toner image. The developer thin layer on the developing sleeve 4*b* passing through the developing portion is returned to a developer returning portion in the developing container 4*a* by further rotation of the developing sleeve 4*b*.

In order to keep a toner concentration (content) in the two-component developer contained in the developing container 4*a* at a substantially constant level, the toner concentration in the two-component developer is detected by, e.g., an optical toner concentration sensor (not shown). Depending on the detected information, toner is supplied to the two-component developer in the developing container 4*a* by controlling a rotation operation of an unshown toner supplying screw disposed in the toner hopper 4*e*. The toner supplied to the two-component developer is stirred by the stirring members 4*d*.

In this embodiment, the image forming apparatus includes the intermediary transfer belt 16 as a transfer means. In this embodiment, the primary transfer apparatus 5 is a transfer roller. The primary transfer roller 5 is pressed against the photosensitive drum 2 at a transfer portion T with a predetermined pressing force. To the primary transfer roller 5, a transfer bias of a positive polarity (+2 kV in this embodiment) opposite to a negative polarity as the normal opposite polarity of the toner is applied from the power source S3. As a result, the toner image is successively transferred from the surface of the photosensitive drum 2 onto the surface of the intermediary transfer belt 16.

In this embodiment, the cleaner-less system (method) is employed. That is, each image forming unit is not provided with a dedicated cleaning apparatus for removing transfer residual toner remaining on the surface of the photosensitive drum 2 in some amount after the toner image is transferred onto the intermediary transfer belt 16.

The transfer residual toner on the photosensitive drum 2 after the transfer operation is conveyed to the developing portion A after passing through a charging portion C and an exposure portion E by further rotation of the photosensitive drum 2 and is removed and collected by the developing apparatus 4 through the simultaneous development and cleaning (cleaner-less system).

In this embodiment, the developing sleeve 4*b* of the developing apparatus 4 is rotated in the direction opposite from the surface movement direction of the photosensitive drum 2 at the developing portion A as described above. Such a rotation of the developing sleeve 4*b* is advantageous for collection of the transfer residual toner from the photosensitive drum 2. The transfer residual toner on the photosensitive drum 2 passes through the exposure portion E, so that the exposure step is performed from above the transfer residual toner. An amount of the transfer residual toner is ordinarily small, so that the exposure step is not adversely affected significantly by the transfer residual toner through which the exposure step is performed.

However, as described above, the transfer residual toner contains particles of the normally charged toner, the reversely charged toner, and the less charged toner in mixture. When the particles of reversely charged toner and less charged toner of these toner particles are deposited on the charging roller 3 at the time the particles pass through the charging portion C, the charging roller 3 is contaminated with the transfer residual toner at a level exceeding an acceptable level, thus causing charging failure in some cases.

In order to effectively remove and collect the transfer residual toner on the photosensitive drum 2 by the developing apparatus 4 simultaneously with the developing operation, an amount of electric charge of the transfer residual toner is an important factor. More specifically, the transfer residual toner on the photosensitive drum 2 carried and conveyed to the developing portion A may preferably have a positive charge polarity and a charge amount capable of developing the electrostatic latent image on the photosensitive drum 2 by the developing apparatus 4. In the cases where the charge polarity of the transfer residual toner is reversed and the charge amount of the transfer residual toner is not appropriate, the transfer residual toner cannot be removed and collected from the photosensitive drum 2 in the developing apparatus 4, thus causing an occurrence of a defective image.

According to the present invention, the auxiliary charging apparatus 6 is provided downstream from the transfer portion T at which the transfer means (transfer roller) 5 is provided and upstream from the charging portion C at which the charging means (charging roller) 3 is provided, with respect to the rotational direction of the photosensitive drum 2.

In this embodiment, the auxiliary charging apparatus 6 includes, as a first auxiliary charging means, a residual toner uniformizing means (residual developer uniformizing means) 6*a* for uniformizing (i.e., electrically discharging) the transfer residual toner on the photosensitive drum 2. Further, in this embodiment, as a second auxiliary charging means (electric charge imparting means for imparting electric charge to the toner), a toner charge amount control means (developer charge amount control means) 6*b* is provided. The toner charge amount control means 6*b* is provided at a position downstream from the residual toner uniformizing means 6*a* and upstream from the charging portion C with respect to the rotational direction of the photosensitive drum 2. The toner charge amount control means 6*b* has the function of uniformizing the charge polarity of the transfer residual toner to the negative polarity as the normal polarity.

Generally, the transfer residual toner remaining on the photosensitive drum 2 without being transferred contains the reversely charged toner and the toner having an inappropriate charge amount in mixture. The transfer residual toner is once electrically discharged by the residual toner uniformizing means 6*a* and then is electrically charged again to the normal charge polarity of the toner by the toner charge amount control means 6*b*. As a result, prevention of deposition of the transfer residual toner on the charging roller 3 can be effectively realized and at the same time, removal and collection of the transfer residual toner by the developing apparatus 4 can be performed completely. For this reason, it is also possible to effectively prevent an occurrence of a ghost image of an image pattern of the transfer residual toner.

Figure 3:
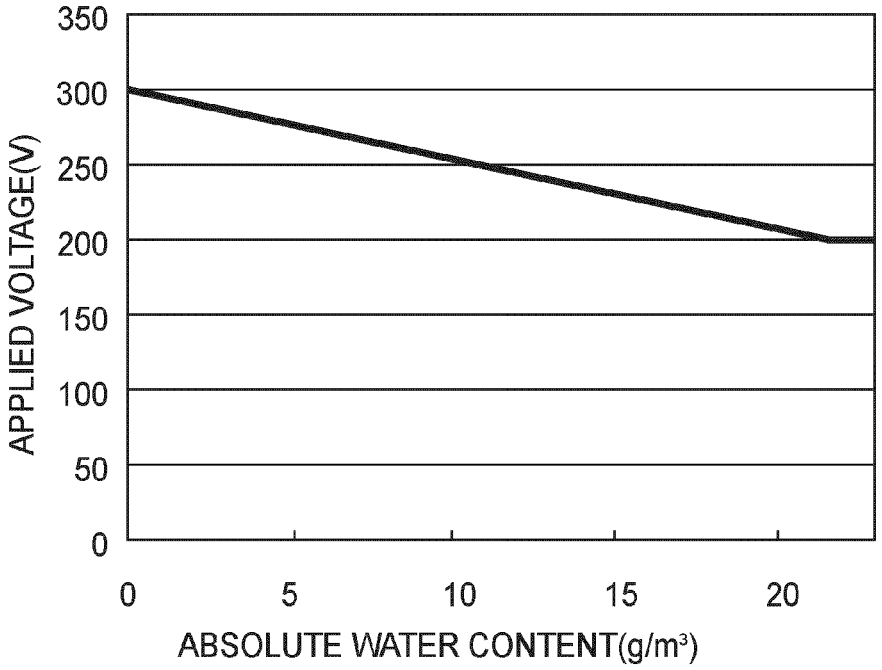
FIG. 3(*a*) is a graph showing a relationship between an absolute water content and a voltage applied to a residual toner uniformizing means, and FIG. 3(*b*) is a graph showing a relationship between the absolute water content and a voltage applied to a toner charge amount control means.
Figure 3:
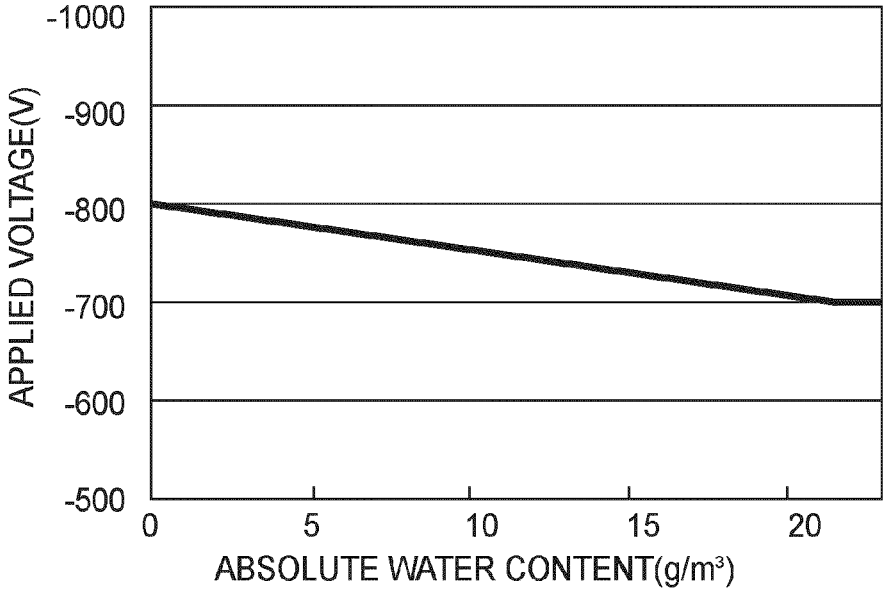

In this embodiment, the residual toner uniformizing means 6*a* and the toner charge amount control means 6*b* are brush-like members having a proper electroconductivity and a brush portion of each of the brush-like members is disposed in contact with the surface of the photosensitive drum 2. As a result, a contact portion between the residual toner uniformizing means 6*a* and the surface of the photosensitive drum 2 and a contact portion between the toner charge amount control means 6*b* and the surface of the photosensitive drum 2 are created. To the residual toner uniformizing means 6*a*, a positive DC voltage is applied from a power source S4, and to the toner charge amount control means 6*b*, a negative DC voltage is applied from a power source S5. Values of the DC voltages applied to the respective brushes are changed as shown in FIGS. 3(*a*) and 3(*b*) depending on an absolute water content calculated from a temperature and a relative humidity which are detected by a temperature and humidity sensor S provided in the image forming apparatus. For example, in an environment of a temperature of 23° C. and an absolute water content of 10.5 g/m$^3$, a voltage of +250 V is applied to the residual toner uniformizing means 6*a* and a voltage of −750 V is applied to the toner charge amount control means 6*b*.

The transfer residual toner remaining on the photosensitive drum 2 after the toner image is transferred onto the intermediary transfer belt 16 at the transfer portion T is conveyed to the contact portion between the residual toner uniformizing means 6*a* and the photosensitive drum 2, where the transfer residual toner is uniformed in charge amount at a value close to 0 μC/g by the residual toner uniformizing means 6*a*. The electrically uniformized transfer residual toner on the photosensitive drum 2 is conveyed to the contact portion between the toner charge amount control means 6*b* and the photosensitive drum 2, where the charge polarity of the transfer residual toner is uniformized to the negative polarity as the normal charge polarity of the toner by the toner charge amount control means 6*b*. By uniformizing the charge polarity of the transfer residual toner to the negative polarity as the normal charge polarity of the toner, the transfer residual toner can be prevented from being deposited on the charging roller 3. More specifically, a mirror force of the transfer residual toner with respect to the photosensitive drum 2 is increased when the surface of the photosensitive drum 2 is electrically charged from above the transfer residual toner at the contact portion (charging portion C) between the charging roller 3 and the photosensitive drum 2 to prevent the transfer residual toner from depositing on the charging roller 3. For this purpose, an amount of electric charge applied to the transfer residual toner by the toner charge amount control means 6*b* may preferably be about two times that of the toner during the development and is about −50 μC/g in the environment of the temperature of 23° C. and the absolute water content of 10.5 g/cm$^3$.

The auxiliary charging apparatus 6 constituted by the first and second auxiliary charging means 6*a* and 6*b* is operatively connected with a reciprocating mechanism (not shown) which is driven together with the photosensitive drum 2. By this reciprocating mechanism, the first and second auxiliary charging means 6*a* and 6*b* are reciprocated in a main scanning direction (rotational axis direction of the photosensitive drum 2), thereby efficiently collecting the transfer residual toner on the photosensitive drum 2 by the toner charge amount control means 6*b*.

(Collection of Transfer Residual Toner)

Next, the collection of the transfer residual toner in the developing step will be described. As described above, the developing apparatus 4 collects the transfer residual toner simultaneously with the development to clean the photosensitive drum surface. A toner charge amount (average value) used for developing the electrostatic latent image on the photosensitive drum 2 is about −25 μC/g in the environment of the temperature of 23° C. and the absolute water content of 10.5 g/m$^3$. In order to ensure sufficient collection of the transfer residual toner on the drum 2 in the developing apparatus 4, it is preferable that the transfer residual toner reaching the developing apparatus 4 has a charge amount in a range of −15 μC/g to −35 μC/g. However, as described above, in order to collect in the developing apparatus 4 the transfer residual toner which has been negatively charged to have the charge amount of −50 μC/g by the toner charge amount control means 6*b* so as to prevent the deposition of the transfer residual toner on the charging roller 3, it is necessary to perform electric charge removal. To the charging roller 3, the AC voltage (frequency=1.3 kHz, peak-to-peak voltage Vpp=1.5 kV) has been applied for electrically charging the surface of the photosensitive drum 2. At that time, the charging roller 3 electrically charges the photosensitive drum surface and at the same time, the transfer residual toner on the photosensitive drum 2 is charge-removed by the AC voltage application. The negatively large charge amount (−50 μC/g) of the transfer residual toner under the AC voltage application condition is decreased to about −30 μC/g in terms of an absolute value after the transfer residual toner passes through the charging portion C. As a result, in the developing step, the transfer residual toner which is the toner deposited at a portion (non-image portion) where the toner on the photosensitive drum 2 should not be deposited is collected in the developing apparatus 4.

In the above-described manner, (i) the charge amount of the transfer residual toner conveyed from the transfer portion T to the charging portion C by the rotation of the photosensitive drum 2 is uniformed to the negative polarity as the normal toner charge polarity by electrically charging the transfer residual toner with the toner charge amount control means 6*b*, so that the deposition of the transfer residual toner on the charging roller 3 is prevented, and (ii) the surface of the photosensitive drum 2 is electrically charged to a predetermined potential by the charging roller 3, and at the same time, the charge amount of the transfer residual toner electrically charged negatively to have the normal toner charge polarity by the toner charge amount control means 6*d* is controlled by the developing apparatus 4 so as to be the same level as that during the development on the photosensitive drum 2.

As a result, the collection of the transfer residual toner by the developing apparatus 4 is performed efficiently. According to the above-described cleaner-less system, particularly the simultaneous development and cleaning method, it is not necessary to particularly provide the cleaning apparatus as described above and the transfer residual toner can be used again without producing waste toner, so that the system or method not only largely contributes to elimination of inconvenience of maintenance and downsizing of the image forming apparatus but also is preferable in terms of environmental protection and effective use of resources.

In this embodiment, polishing particles having a property of being electrically charged to an opposite polarity to the normal toner charge polarity are contained in the developer in the developing apparatus 4 and in the supply toner.

In this embodiment, the toner has the negative charge polarity and the polishing particles comprise strontium titanate having the positive charge polarity. More specifically, the polishing particles of strontium titanate have an average primary particle size of 30 nm or more and 300 nm or less, a cubic or rectangular parallelepiped particle shape, and perovskite crystal. In the case of using such polishing particles of strontium titanate, it is possible to effectively remove an electric discharge product even in an image forming apparatus provided with no member for strongly rubbing the photosensitive drum 2 such as a cleaner blade. In this embodiment, the polishing particles are added in the amount of 0.1-6.0 wt. %, ordinarily 0.2 wt. % in the toner.

As described above, by electrically charging the polishing particles to an opposite polarity to the charge polarity of the toner, an amount of the polishing particles transferred onto the intermediary transfer belt 16 can be reduced as small as possible, so that it is possible to stably supply the polishing particles to the auxiliary charging apparatus 6.

The polishing particles are isolated in the developer and supplied from the developing sleeve 4*b* to the photosensitive drum 2 when a fog-removing bias (Vback potential) is generated principally between the developing apparatus 4 and the photosensitive drum 2.

The polishing particles are deposited on the auxiliary charging apparatus 6 after passing through the transfer portion T. In this embodiment, the polishing particles having the positive charge polarity are used, so that the polishing particles are accumulated in a larger amount on the toner charge amount control means 6*b*. In this embodiment, the above-described fog-removing bias (Vback potential) is 150 V.

Figure 4:
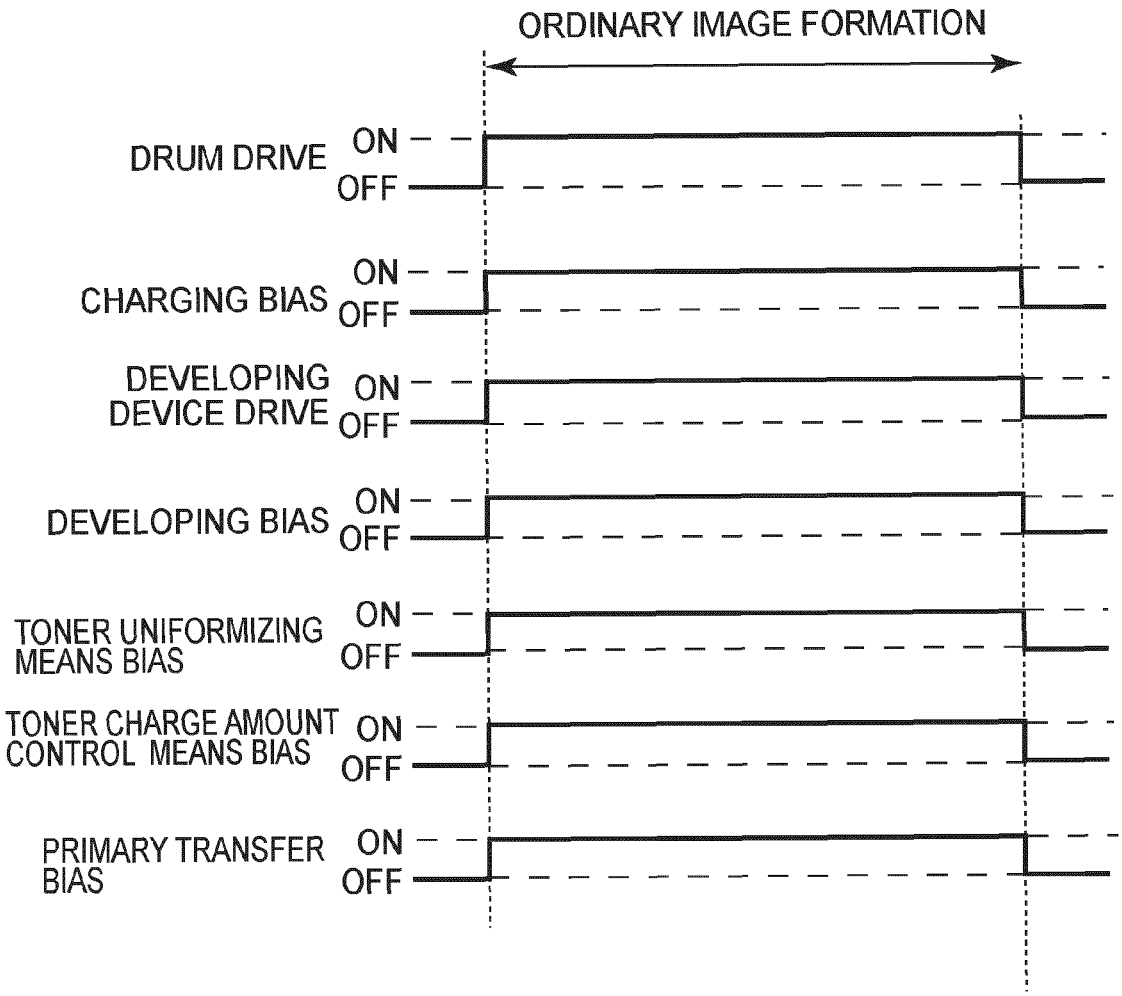
FIG. 4 is a time chart during ordinary image formation of the image forming apparatus of the present invention.

FIG. 4 shows a time chart during ordinary image formation.

In this embodiment, in the case where there are unit(s) subjected to image formation and unit(s) not subjected to image formation during single color image formation or the like, the following operation is performed.

In a state in which a photosensitive drum of the unit not subjected to image formation contacts the transfer apparatus (intermediary transfer member) similarly as in ordinary image formation, the photosensitive drum is idled. As a result, it is not necessary to provide a mounting/demounting mechanism for the transfer apparatus, so that it is possible to achieve downsizing, cost reduction and high productivity of the image forming apparatus.

Here, a problem occurring in the image forming apparatus employing the above-described constitution will be described.

In this embodiment, in the case of continuously performing image formation of a single color of black, the following problem arose by idling of photosensitive drums for yellow, magenta and cyan.

The polishing particles deposited with respect to the auxiliary charging apparatus 6 are removed by rubbing against the rotating photosensitive drum to be used. As a result, in the case where image formation of the single color of black was continuously performed on 1000 sheets in an environment of 23° C. and 70% RH, the amount of the polishing particles deposited to the auxiliary charging apparatus 6 was insufficient at the image forming units for yellow, magenta and cyan. For this reason, during subsequent image formation, image flow was caused to occur with respect to yellow, magenta and cyan.

In this embodiment, at the image forming units not subjected to image formation, the amount of the polishing particles deposited to the auxiliary charging means is controlled by forming a potential difference between the photosensitive drum and the auxiliary charging means. More specifically, during the single color image formation, a bias of an opposite polarity (negative in this embodiment) to that of the polishing particles is applied to the auxiliary charging means, i.e., the toner charge amount control means 6*b* of the image forming units for the other colors not subjected to image formation. As a result, a potential difference for holding the polishing particles is formed, so that the polishing particles deposited to the auxiliary charging means 6*b* of the image forming units for the other colors can be prevented from being removed even in the case of continuously performing the image formation of the single color of black. Further, it was possible to always deposit a stable amount of the polishing particles to the auxiliary charging means 6*b*.

This operation will be described more specifically with reference to FIG. 5 and Table 1 shown below.

Figure 5:
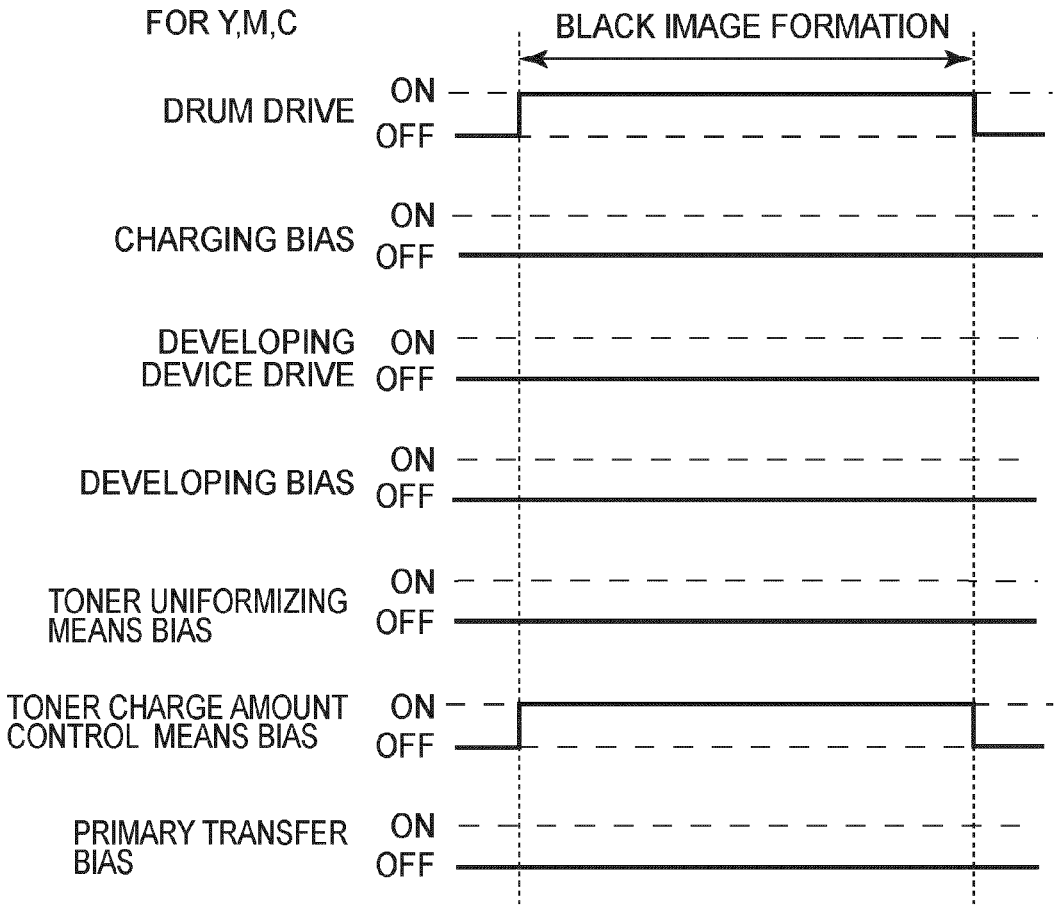
FIG. 5 is a time chart with respect to yellow, magenta and cyan during image formation of a single color of black in Embodiment 1 of the present invention.

FIG. 5 shows a time chart with respect to members or biases for yellow, magenta and cyan during the black image formation (single color image formation). In the case of performing the black image formation by the image forming apparatus, photosensitive drums of the image forming units for yellow, magenta and cyan are idled. In this case, during rotation of the photosensitive drums, a DC voltage of an opposite polarity (negative in this embodiment) to that of the polishing particles is applied to the toner charge amount control means 6*b* of the auxiliary charging means 6.

Table 1 shows voltages applied to the toner charge amount control means 6*b* are decreasing rates of the photosensitive drums after 1000 sheets of a black (single color) image are continuously outputted. The black image formation is performed at process speeds of 100 mm/sec, 150 mm/sec, 200 mm/sec, and 250 mm/sec.

TABLE 1

| | Decreasing rate (%) | | | |
|---|---|---|---|---|
| Applied voltage | 100 (mm/sec) | 150 (mm/sec) | 200 (mm/sec) | 250 (mm/sec) |
| 0 V | 50 | 55 | 60 | 65 |
| −50 V | 30 | 35 | 40 | 45 |
| −100 V | 20 | 23 | 27 | 30 |
| −150 V | 5 | 6 | 6 | 7 |
| −200 V | 5 | 6 | 6 | 7 |

As shown in Table 1, at the process speeds from about 100 min/sec to about 250 mm/sec, the following effect can be achieved by applying the voltage of −150 V to the toner charge amount control means 6*b*. Even in the case where the black image formation was continuously performed on 1000 sheets, the amount of the polishing particles deposited to the toner charge amount control means 6*b* was substantially not changed, so that image flow was not caused to occur during subsequent image formation.

The voltage applied to the toner charge amount control means 6*b* may desirably be an electric discharge start voltage or less. This is because a discharge product is formed by occurrence of electric discharge to be deposited on the photosensitive drum surface.

As described above, according to the present invention, the voltage of the opposite polarity to that of the polishing particles is applied to the auxiliary charging means, i.e., the toner charge amount control means 6*b* of the image forming units, for other colors not subjected to image formation during the single color image formation. As a result, the amount of the polishing particles deposited to the auxiliary charging means 6*b* is controlled. For this reason, even in the case where the photosensitive drum is idled for a long term without being subjected to image formation, it was possible to prevent the polishing particles deposited to the auxiliary charging means 6 from being used up, so that it was possible to always deposit a stable amount of the polishing particles to the auxiliary charging apparatus 6. As a result, it was possible to provide an image forming apparatus causing no image flow during subsequent image formation.

In this embodiment, during the black image formation, the voltage of the opposite polarity to that of the polishing particles is applied to the auxiliary charging means 6*b* during idling of the photosensitive drums of the image forming units for yellow, magenta and cyan which are not subjected to image formation. However, the present invention is not limited thereto but may also be applicable to the case of performing image formation of a single color other than black and the case of performing image formation using image forming units for a plurality of colors. More specifically, also in these cases, the application of the voltage of the opposite polarity to that of the polishing particles to the auxiliary charging means 6*b* is effective.

In this embodiment, the voltage of −150 V is applied to the toner charge amount control means 6*b* but the present invention is not limited thereto. As described above, the same effect as in this embodiment can be achieved so long as the potential difference between the toner charge amount control means 6*b* and the photosensitive drum 2 is not more than a potential difference causing electric discharge.

Embodiment 2

In this embodiment, when an idling operation of a photosensitive drum performed at the time of turning a power source of an image forming apparatus on is carried out, a bias of a polarity opposite to that of the polishing particles is applied to the toner charge amount control means 6*b* of the auxiliary charging means. Details are described below.

In Embodiment 1, such a constitution that during the single color image formation or the like, the bias (voltage) of the opposite polarity to that of the polishing particles is applied to the auxiliary charging means, i.e., the toner charge amount control means 6*b* of other color image forming units which are not subjected to image formation is employed. By such a constitution, even in the case where the photosensitive drums are idled for a long term without being subjected to image formation, it was possible to prevent the polishing particles deposited to the auxiliary charging apparatus 6 from being used up and it was possible to always deposit a stable amount of the polishing particles to the auxiliary charging apparatus 6.

In this embodiment, when an idling operation of a photosensitive drum performed at the time of turning a power source of an image forming apparatus on is carried out, a bias of a polarity opposite to that of the polishing particles is applied to the toner charge amount control means 6*b* of the auxiliary charging means Detailed are described below.

In order to prevent image flow occurring after the image forming apparatus is left standing for a long term, removal of the discharge product deposited on the photosensitive drum surface has generally been widely performed by carrying out the idling operation of the photosensitive drum when the power source of the image forming apparatus is turned on. Also in the image forming apparatus in this embodiment, the idling of the photosensitive drum is performed for a predetermined time (100 sec in this embodiment). Accordingly, in this embodiment, by depositing the polishing particles to the auxiliary charging apparatus 6, it is possible to effectively remove the discharge product during the idling of the photosensitive drum.

However, the idling operation of the photosensitive drum is repeated every turning-on of the power source of the image forming apparatus, so that the polishing particles are gradually removed from the auxiliary charging apparatus 6 by rubbing against the rotating photosensitive drum. As a result, such a problem that the polishing particles deposited to the auxiliary charging apparatus 6 are used up arose.

In this embodiment, when the idling operation of the photosensitive drum performed at the time of turning the power source of the image forming apparatus on is carried out, the bias of the opposite polarity to that of the polishing particles is applied to the toner charge amount control means 6*b* of the auxiliary charging apparatus 6.

Figure 6:
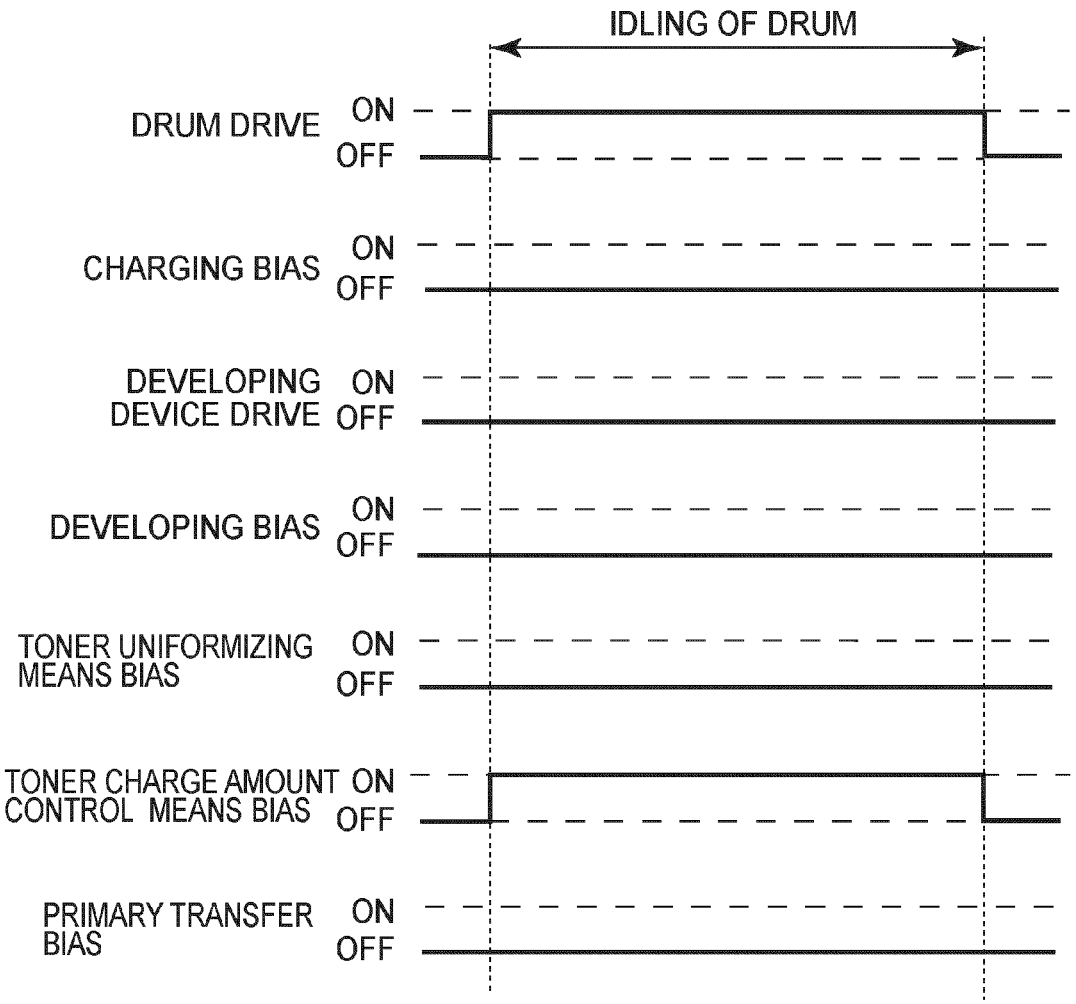
FIG. 6 is a time chart for a photosensitive drum idling operation after a power source is turned on in Embodiment 2 of the present invention.

A time chart when the idling operation of the photosensitive drum performed after the power source of the image forming apparatus is turned on is shown in FIG. 6.

In this embodiment, when the above-described idling operation of the photosensitive drum is performed (during the idling operation), the voltage is not applied to the charging roller 3. This is because electric discharge deterioration of the photosensitive drum 2 due to excessive application of a charging voltage during non-image formation or the like can be prevented.

In this embodiment, when the power source of the image forming apparatus is turned on, a mode in which the idling of the photosensitive drum 2 is performed is executed in a state in which a voltage of −150 V is applied to the toner charge amount control means 6*b* of the auxiliary charging apparatus 6. This mode is executed for 100 sec by a CPU 200 as an executing means (control means) for executing the mode. The CPU 300 executes the above-described mode by controlling respective power sources S1 to S5 and rotating the photosensitive drum 2 as shown in FIG. 2. As a result, it was possible to remove the discharge product deposited on the photosensitive drum surface, thereby suppressing an occurrence of image flow even in a high-humidity environment. It was also possible to prevent the photosensitive drums deposited to the auxiliary charging means 6*b* from being removed, thereby performing stable image formation always free from the occurrence of image flow.

In this embodiment, when the idling operation of the photosensitive drum performed at the time of turning the power source of the image forming apparatus on is carried out, the bias of the opposite polarity to that of the polishing particles is applied to the auxiliary charging means 6*b* but the present invention is not limited thereto. For example, after the power source of the image forming apparatus is turned on, the application of the bias of the opposite polarity to that of the polishing particles to the auxiliary charging means 6*b* during pre-rotation for copy job start, during post-rotation after the copy job is completed, or during idling of the photosensitive drum during the copy job execution, is also effective.

Embodiment 3

In this embodiment, an image forming apparatus and an image forming process are substantially identical to those in Embodiments 1 and 2, so that a redundant description will be appropriately omitted.

In Embodiments 1 and 2, in the case where the idling operation of the photosensitive drum 2 is performed during the non-image formation, removal of the polishing particles by performing the idling operation of the photosensitive drum 2 is prevented by forming a desired potential difference between the photosensitive drum 2 and the auxiliary charging means 6*b*.

However, e.g., in the case where a user carries out image formation of a single color of black for a long term, idling of photosensitive drums of image forming units for yellow, magenta and cyan is performed for the long term and image formation at these image forming units is not performed. For this reason, the polishing particles are not supplied to the auxiliary charging apparatus 6. As a result, even in the case where the constitutions as described in Embodiments 1 and 2 are employed, the polishing particles of the auxiliary charging apparatus 6 are used up, so that the image flow can occur.

In this embodiment, the following operation is performed. At predetermined timing, a desired potential difference is created between the photosensitive drum 2 and the auxiliary charging means 6*b* with respect to each of the image forming units which are not subjected to image formation, and a supplying operation of the polishing particles from an associated developing apparatus 4 to an associated auxiliary charging apparatus 6 is performed.

More specifically, in the case where the black image formation is performed by the image forming apparatus, the photosensitive drums 2 of the image forming units for yellow, magenta and cyan which are not subjected to image formation are idled. In this case, a voltage of −150 V is applied to the toner charge amount control means 6*b* of the auxiliary charging apparatus 6 during rotation of the photosensitive drums 2.

Figure 7:
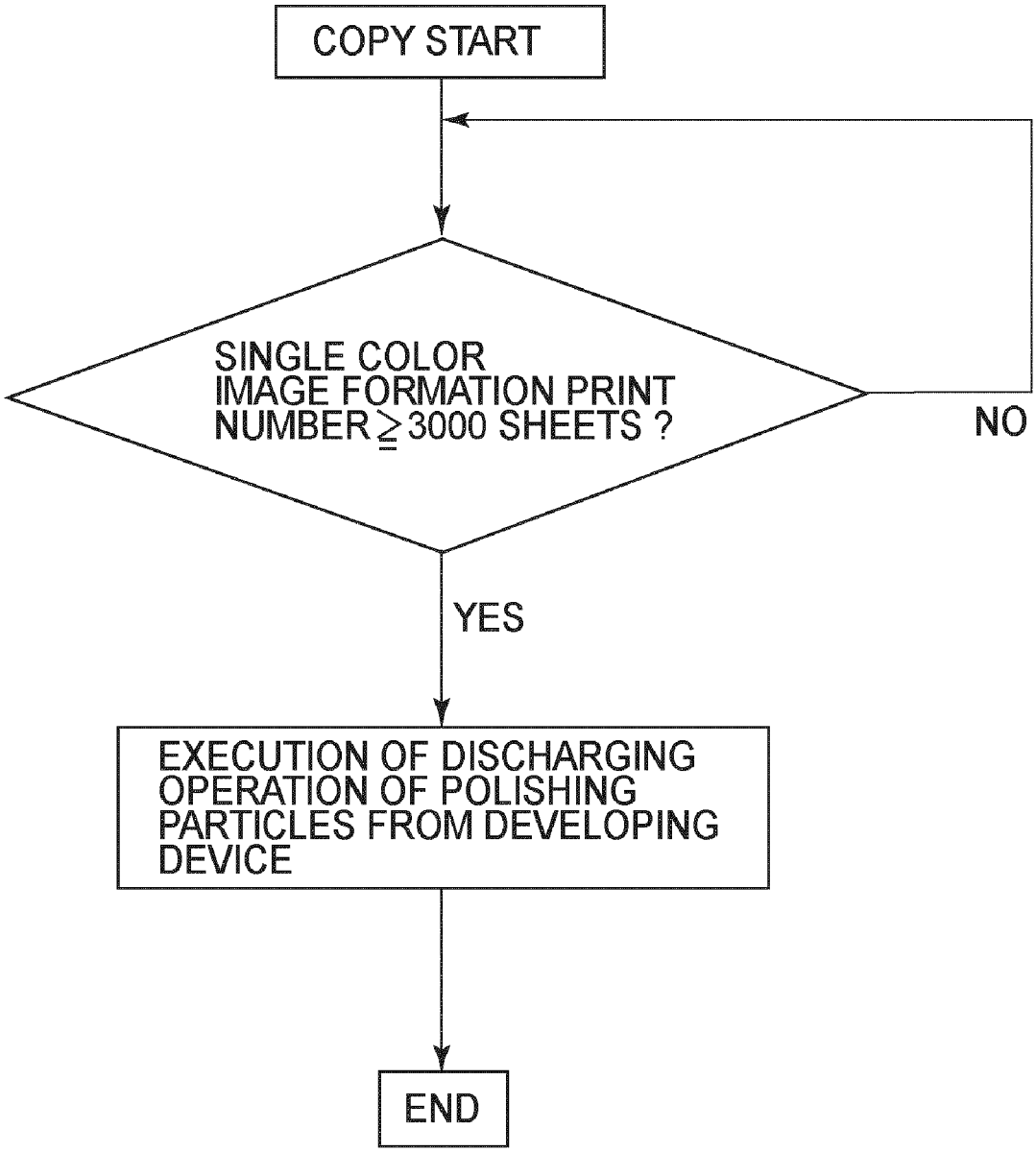
FIG. 7 is a flowchart for determining whether or not a supplying operation of polishing particles in Embodiment 3 of the present invention is performed.

FIG. 7 shows a flowchart of this operation. At the set timing, in this embodiment, predetermined voltages are applied to the charging roller 3 and the developing sleeve 4*b* with respect to the image forming units which are not subjected to image formation in the case where a continuous print number of the black image formation reaches a predetermined number (3000 sheets in this embodiment). As a result, a potential difference is created between the photosensitive drum 2 and the developing sleeve 4*b*. In this embodiment, a voltage of −400 V is applied to the charging roller 3 and a voltage −200 V is applied to the developing sleeve 4*b*. Further, by actuating (driving) the developing apparatus 4 for 30 sec, the polishing particles are discharged from the developing apparatus 4 by utilizing the potential difference between the photosensitive drum and the developing sleeve. The discharged polishing particles are collected by the auxiliary charging apparatus 6.

Figure 8:
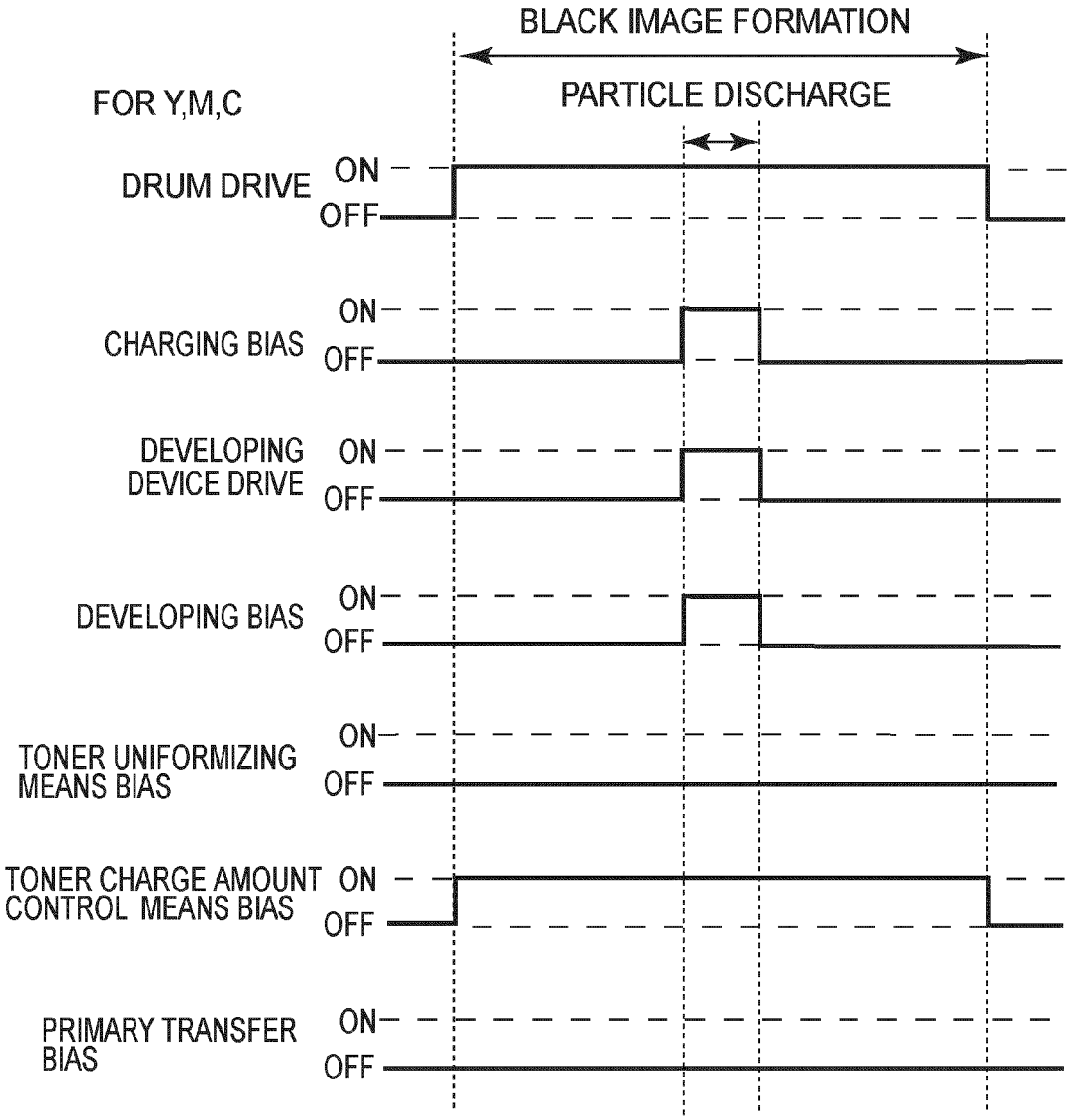
FIG. 8 is a time chart with respect to yellow, magenta and cyan during image formation of a single color of black in Embodiment 3 of the present invention.

FIG. 8 shows a time chart with respect to members and biases for yellow, magenta and cyan during black image formation. In this embodiment, the above-described polishing particles supplying operation is performed during the black image formation but may also be performed during post-rotation after completion of the black image formation.

As described above, during the single color image formation, the desired potential difference is formed between the photosensitive drum 2 and the toner charge amount control means 6*b* with respect to non-image forming units, and the polishing particles supplying operation from the developing apparatus 4 to the auxiliary charging means 6*b* with respect to the non-image forming units is carried out at the predetermined timing. By employing such a constitution, even in the case where the photosensitive drum 2 is idled for a long term without being subjected to image formation, it is possible to prevent the polishing particles deposited to the auxiliary charging apparatus 6 from being used up, thereby to always depositing a stable amount of the polishing particles to the auxiliary charging apparatus 6. As a result, it was possible to provide an image forming apparatus causing no image flow.

In this embodiment, during the idling of the photosensitive drums of the non-image forming units for yellow, magenta and cyan at the time of forming a black (sing color) image, the voltage of the opposite polarity to that of the polishing particles is applied to the auxiliary charging means 6*b*. Further, at the predetermined timing, the polishing particles supplying operation from the developing apparatus 4 to the auxiliary charging means 6*b* with respect to the non-image forming units is carried out.

However, the present invention is not limited to the above-described constitution but may also be similarly applicable to the case of forming an image of a single color other than black or the case of performing image formation at the image forming units for a plurality of colors. In other words, such a constitution that the voltage of the opposite polarity to that of the polishing particles is applied to the auxiliary charging means 6*b* during rotation of the photosensitive drum with respect to the image forming units which are not subjected to image formation, and the polishing particles supplying operation from the developing apparatus 4 to the auxiliary charging apparatus 6 with respect to the non-image forming units is carried out at the predetermined timing, is also effective.

Embodiment 4

In this embodiment, an image forming apparatus and an image forming process are substantially identical to those in Embodiments 1 to 3, so that a redundant description will be appropriately omitted.

In Embodiment 3, during the single color image formation, with respect to the non-image forming units, the desired potential difference is created between the photosensitive drum 2 and the auxiliary charging means 6*b* and the polishing particles supplying operation from the developing apparatus 4 to the auxiliary charging means 6*b* is performed at the predetermined timing.

Figure 9:
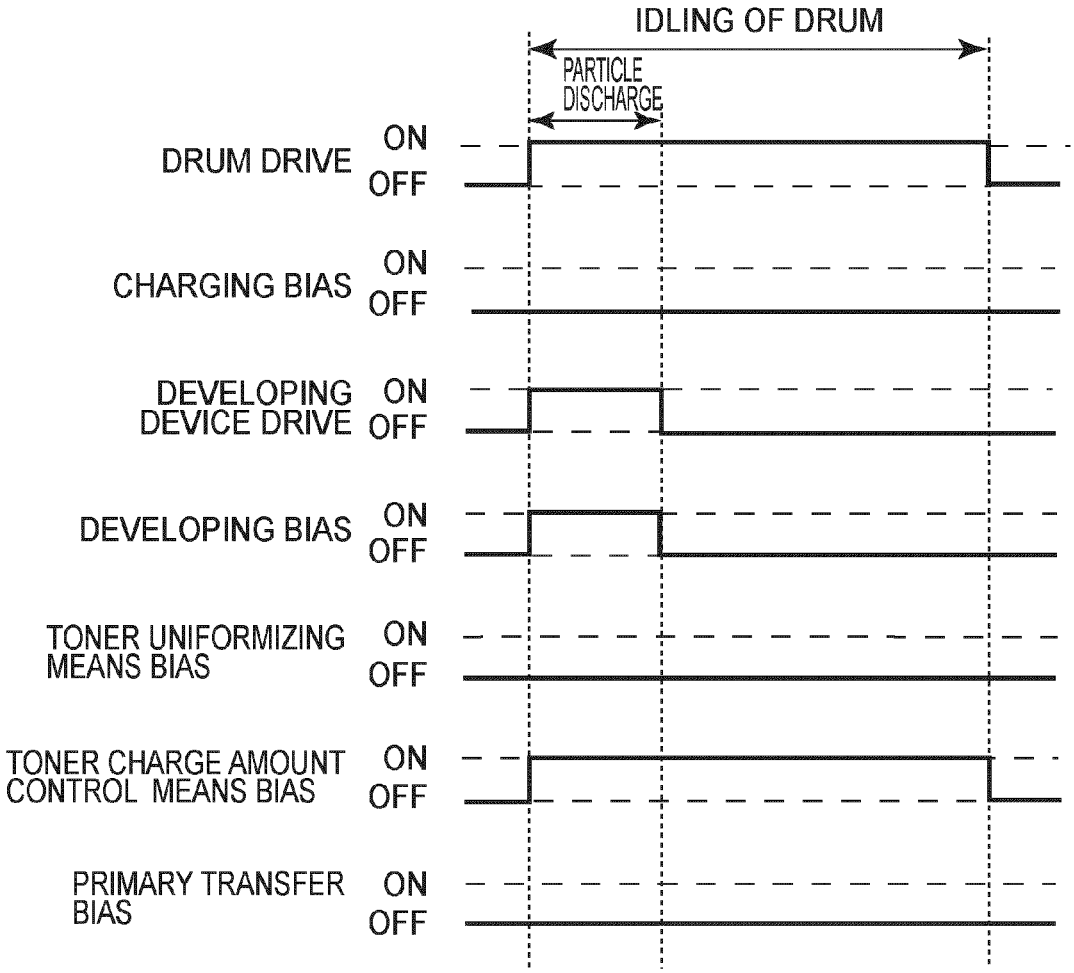
FIG. 9 is a time chart for a photosensitive drum idling operation after a power source is turned on in Embodiment 4 of the present invention.

FIG. 9 shows a time chart during an idling operation of a photosensitive drum performed after a power source of an image forming apparatus in this embodiment is turned on.

In this embodiment, similarly as in Embodiment 2, idling of the photosensitive drum 2 is performed for 100 sec in a state in which a voltage of −150 V is applied to the toner charge amount control means 6*b* of the auxiliary charging apparatus 6 at the time of turning the power source of the image forming apparatus on. Further, at the substantially same time as the start of the idling of the photosensitive drum 2, a voltage of +200 V is applied to the developing sleeve 4*b* of the developing apparatus 4. By actuating the developing apparatus 4 for 10 sec, the polishing particles are discharged from the developing apparatus 4 by utilizing a potential difference created between the photosensitive drum and the developing sleeve. The discharged polishing particles are collected by the auxiliary charging apparatus 6.

By this operation, even in the case where the photosensitive drum is idled for a long term without being subjected to image formation, it was possible to prevent the polishing particles deposited to the auxiliary charging apparatus 6 from being used up, thereby always depositing a stable amount of the polishing particles to the auxiliary charging apparatus 6, i.e., the toner charge amount control means 6*b*. As a result, it was possible to provide an image forming apparatus causing no image flow.

In the above-described embodiments, the present invention is described with respect to the image forming apparatus of the intermediary transfer type but the image forming apparatus of the present invention is not limited thereto.

Figure 10:
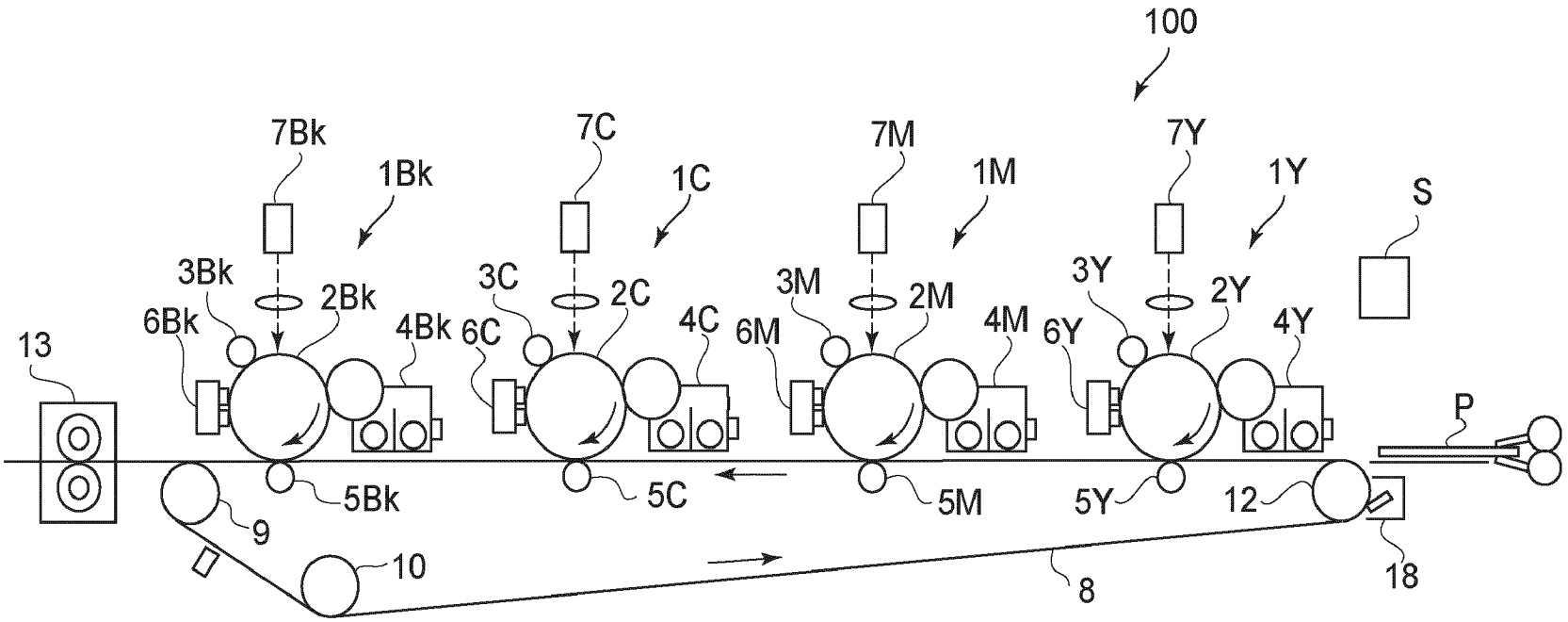
FIG. 10 is a schematic constitutional view of another embodiment of the image forming apparatus of the present invention.

For example, the present invention is similarly applicable to an image forming apparatus of the type, as schematically shown in FIG. 10, wherein a toner image on the photosensitive drum 2 is directly transferred onto a transfer medium, i.e., the recording material P by the transfer apparatus 5. The image forming apparatus 100 shown in FIG. 10 includes a conveying belt 8 for conveying the recording material P, in place of the intermediary transfer belt 16 as the intermediary transfer member. In this embodiment, a constitution of the image forming apparatus and image forming units is identical to those described with reference to FIGS. 1 and 2 except that the image forming apparatus 100 is not provided with the intermediary transfer belt. Accordingly, members or means having the same structure and function as those shown in FIGS. 1 and 2 are represented by the same reference numerals or symbols. The image forming apparatus shown in FIG. 10 is capable of achieving the same action and effect as in the image forming apparatuses in the preceding embodiments.

As described above, in the present invention, the image forming apparatus including the plurality of image forming units is described but the present invention is also applicable to even an image forming apparatus having a single photosensitive drum and a single image forming unit. For example, in order to prevent fusion of toner with respect to the single photosensitive drum, during non-image formation, the photosensitive drum may also be idled in a state in which a voltage of the polarity opposite to that of the polishing particles is applied to the electric charge imparting means.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 322677/2006 filed Nov. 29, 2006, which is hereby incorporated by reference.

What is claimed is:

1. An image forming apparatus comprising:

a first image forming portion including:

a rotatable first photosensitive member;

a first charging device for electrically charging said first photosensitive member;

a first exposure device for exposing to light said first photosensitive member electrically charged by said first charging device to form an electrostatic image;

a first developing device for developing the electrostatic image into a toner image; and a first transfer device for transferring the toner image formed by said first developing device onto an image receiving member;

a second image forming portion including:

a rotatable second photosensitive member;

a second charging device for electrically charging said second photosensitive member;

a second exposure device for exposing to light said second photosensitive member electrically charged by said second charging member to form an electrostatic image;

a second developing device which includes a developer containing toner and polishing particles of a polarity opposite to a normal charge polarity of the toner and which is configured to develop the electrostatic image formed on said second photosensitive member into a toner image with the toner;

a second transfer device for transferring the toner image formed by said second developing device onto the image receiving member;

an auxiliary charging member which is disposed in contact with said second photosensitive member and which is disposed downstream of said second transfer device and upstream of said second charging device with respect to a rotational direction of said second photosensitive member; and an applying device for applying to said auxiliary charging member a bias of a polarity opposite to the polarity of the polishing particles so that the toner remaining on said second photosensitive member without being transferred onto the image receiving member during image formation is electrically charged to be collected by said second developing device and so that the polishing particles deposited on said second photosensitive member are collected;

executing means for selectively executing modes including a first mode in which both of said first image forming portion and said second image forming portion are used for image formation and a second mode in which said first image forming portion is used for the image formation but said second image forming portion is not used for the image formation; and a controller for effecting control so that:

(1) when the first mode is executed, a bias is applied to said auxiliary charging member so as to collect transfer residual toner in said second developing device by rotating said second photosensitive member and then electrically charging said second photosensitive member under application of a bias such that electric discharge between said second charging member and said second photosensitive member is caused, and (2) when the second mode is executed, the bias of the polarity opposite to the polarity of the polishing particles is applies to said auxiliary charging member so as to form an electric field, such that the polishing particles are deposited on said auxiliary charging member, between said auxiliary charging member and said second photosensitive member by rotating said second photosensitive member and then changing the bias applied to said auxiliary charging member so as not to cause the electric discharge between said second charging member and said second photosensitive member.

2. An apparatus according to claim 1, wherein when the second mode is executed, said controller controls a potential difference formed between said second photosensitive member and said auxiliary charging member is to be lower than a potential difference for starting electric discharge between said second photosensitive member and said auxiliary charging member.

3. An apparatus according to claim 1, wherein the polishing particles are strontium titanate particles which have an average primary particle size of 30 nm or more and 300 nm or less, a cubic or rectangular parallelepiped particle shape, and perovskite crystal.

4. An apparatus according to claim 1, wherein when the second mode is executed, said controller controls said second developing device so that the polishing particles are supplied from said second developing device to said auxiliary charging member.

* * * * *